US011158986B2

(12) United States Patent
Hirai

(10) Patent No.: US 11,158,986 B2
(45) Date of Patent: Oct. 26, 2021

(54) SHORTING TERMINAL AND CONNECTOR

(71) Applicant: SUMITOMO WIRING SYSTEMS, LTD., Mie (JP)

(72) Inventor: Kentaro Hirai, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/981,929

(22) PCT Filed: Mar. 4, 2019

(86) PCT No.: PCT/JP2019/008259
§ 371 (c)(1),
(2) Date: Sep. 17, 2020

(87) PCT Pub. No.: WO2019/181446
PCT Pub. Date: Sep. 26, 2019

(65) Prior Publication Data

US 2021/0036474 A1 Feb. 4, 2021

(30) Foreign Application Priority Data

Mar. 23, 2018 (JP) ..... JP2018-055783

(51) Int. Cl.
*H01R 29/00* (2006.01)
*H01R 31/08* (2006.01)
*H01R 13/24* (2006.01)

(52) U.S. Cl.
CPC ..... *H01R 31/08* (2013.01); *H01R 13/2457* (2013.01)

(58) Field of Classification Search
CPC ..... H01R 2103/00; H01R 13/641; H01R 13/4223

(Continued)

(56) References Cited

U.S. PATENT DOCUMENTS 5,647,754 A * 7/1997 Kohno ..... H01R 13/7032 439/188
7,901,229 B2 * 3/2011 Nakamura ..... H01R 13/641 439/188

(Continued)

FOREIGN PATENT DOCUMENTS

JP H10-241813 A 9/1998
JP H10-302901 A 11/1998

(Continued)

OTHER PUBLICATIONS

International Search Report dated May 7, 2019 for WO 2019/181446 A1 (4 pages).

*Primary Examiner* — Phuong Chi Thi Nguyen
(74) *Attorney, Agent, or Firm* — Abelman, Frayne & Schwab

(57) ABSTRACT

A shorting terminal includes a base portion, a contact portion, a folded portion, an opposing portion and a protruding portion. The base portion is in the form of a flat plate. The contact portion can short a pair of terminal fittings by contacting the pair of terminal fittings. The folded portion extends in such a manner as to be folded from the base portion. The opposing portion extends from the folded portion toward the contact portion and is formed such that an interval between the base portion and the opposing portion is smaller than an interval between opposing inner surfaces of a shorting terminal holding chamber. The protruding portion extends from the opposing portion to the contact portion and is formed such that an interval between the base portion and the protruding portion is larger than the interval between the opposing inner surfaces of the shorting terminal holding chamber.

5 Claims, 9 Drawing Sheets

(58) Field of Classification Search
USPC ..... 439/188, 489, 595; 200/51.1
See application file for complete search history.

(56) References Cited

U.S. PATENT DOCUMENTS

| | | | | |
|---|---|---|---|---|
| 9,379,472 | B2 | 1/2016 | Hara | |
| 2001/0027043 | A1 | 10/2001 | Shiraki et al. | |
| 2005/0074997 | A1 | 4/2005 | Nakamura | |
| 2015/0140846 | A1* | 5/2015 | Kanemura | H01R 13/7032<br>439/188 |
| 2018/0076576 | A1 | 3/2018 | Ito et al. | |
| 2020/0373711 | A1* | 11/2020 | Miyakawa | H01R 13/4365 |
| 2020/0373718 | A1* | 11/2020 | Miyakawa | B60R 16/0207 |

FOREIGN PATENT DOCUMENTS

| | | | |
|---|---|---|---|
| JP | 2014-229463 | A | 12/2014 |
| JP | 2015-216049 | A | 12/2015 |

* cited by examiner

SHORTING TERMINAL AND CONNECTOR

CROSS REFERENCE TO RELATED APPLICATIONS

This application is a national phase of PCT application No. PCT/JP2019/008,259, filed on 4 Mar. 2019, which claims priority from Japanese patent application No. 2018-055783, filed on 23 Mar. 2018, all of which are incorporated herein by reference.

TECHNICAL FIELD

The present invention relates to a shorting terminal and a connector.

BACKGROUND

Conventionally, a shorting terminal is known which shorts terminal fittings accommodated in a connector in a state before the connector is fit into a mating connector. For example, a shorting terminal disclosed in Patent Document 1 is formed by bending a metal plate. This shorting terminal includes a U-shaped portion having a U shape in a side view and a contact portion extending from one end of the U-shaped portion. This shorting terminal is disposed with the U-shaped portion accommodated in a shorting terminal accommodation chamber of a connector and the contact portion projecting from the shorting terminal accommodation chamber. Terminal fittings accommodated in a connector are shorted by being held in contact with the contact portion.

PRIOR ART DOCUMENT

Patent Document

Patent Document 1: JP 2015-60628A

SUMMARY OF THE INVENTION

Problems to be Solved

In this shorting terminal, it is desired to stabilize the position of the contact portion in a state disposed in the shorting terminal accommodation chamber. To that end, the shorting terminal may be formed to be slightly larger than an inner dimension of the shorting terminal accommodation chamber and accommodated in a deflected state into the shorting terminal accommodation chamber. However, since the connector formed with the shorting terminal accommodation chamber is made of synthetic resin, the inner dimension of the shorting terminal accommodation chamber varies during molding. If the inner dimension of the shorting terminal accommodation chamber varies, a degree of deflection of the U-shaped portion also varies. Thus, the position of the contact portion may not be stabilized.

The present invention was developed in view of the above situation and aims to provide a technique capable of suppressing a variation of the position of a contact portion in a disposed state of a shorting terminal.

Means to Solve the Problem

The present invention is directed to a shorting terminal with a base portion in the form of a flat plate, a contact portion capable of shorting a pair of terminal fittings by contacting the pair of terminal fittings, a folded portion extending in such a manner as to be folded from the base portion, an opposing portion extending from the folded portion toward the contact portion, the opposing portion being formed such that an interval between the base portion and the opposing portion is smaller than an interval between opposing inner surfaces of a shorting terminal holding chamber, and a protruding portion extending from the opposing portion to the contact portion, the protruding portion being formed such that an interval between the base portion and the protruding portion is larger than the interval between the opposing inner surfaces of the shorting terminal holding chamber.

The present invention is directed to a connector with a housing formed with the above shorting terminal holding chamber, and the above shorting terminal to be accommodated into the shorting terminal holding chamber.

Effect of the Invention

The shorting terminal of the present invention is accommodated in a deflected state into the shorting terminal holding chamber after the base portion and the protruding portion are fit into the shorting terminal holding chamber. If an inner dimension of the shorting terminal holding chamber, i.e. an opposing interval between the base portion and the protruding portion varies, an amount of deflection of the folded portion also varies. Thus, the position of the contact portion fluctuates with the folded portion serving as a fulcrum. At this time, the protruding portion serves as a point of action for fluctuating the position of the contact portion and a variation amount of the displacing point of action (protruding portion) has a fixed relationship with a variation of the inner dimension of the shorting terminal holding chamber. The protruding portion is disposed at a position closer to the contact portion than the folded portion. Thus, a distance between the point of action (protruding portion) and the contact portion is short in the shorting terminal of the present invention as compared to a shorting terminal in which the position of a contact portion fluctuates with a folded portion serving as a point of action. Therefore, a variation of the position of the contact portion associated with a variation of the inner dimension of the shorting terminal holding chamber is suppressed to be small.

The connector of the present invention can suppress a variation of the position of the contact portion of the shorting terminal accommodated in the shorting terminal holding chamber.

DETAILED DESCRIPTION TO EXECUTE THE INVENTION (1) The protruding portion in the shorting terminal of the present invention may be accommodated into the shorting terminal holding chamber while being in contact with an end edge on an opening side of the shorting terminal holding chamber.

By doing so, the point of action (protruding portion) is disposed at a position closest to the contact portion in the shorting terminal holding chamber, wherefore a variation of the position of the contact portion associated with a variation of the inner diameter of the shorting terminal holding chamber can be more effectively suppressed.

(2) The protruding portion in the shorting terminal of the present invention may be in surface contact with an inner wall surface of the shorting terminal holding chamber in a state fit in the shorting terminal holding chamber.

By bringing the protruding portion into surface contact with the inner wall surface of the shorting terminal holding chamber, the disposed position of the shorting terminal in the shorting terminal holding chamber can be stabilized. As a result, it can be suppressed that the shorting terminal fit into the shorting terminal holding chamber is shifted in position when terminal fittings are inserted or when a mating connector (not shown) is connected.

(3) A guide surface inclined downward toward an opening side may be formed on an end edge on the opening side of an inner wall surface of the shorting terminal holding chamber in the connector of the present invention. By doing so, the protruding portion of the shorting terminal can be guided into the shorting terminal holding chamber by the guide surface.

Embodiment

Hereinafter, one specific embodiment of the present invention is described with reference to FIGS. 1 to 12B. In the following description, a left side (side to be fit into an unillustrated mating connector) in FIGS. 1, 3 and 6 to 10 is defined as a front side concerning a front-rear direction. A vertical direction in FIGS. 1, 3 to 5 and 8 to 10 is directly defined as a vertical direction. A direction orthogonal to the vertical direction and the front-rear direction is defined as a lateral direction.

Connector 1

Figure 1:
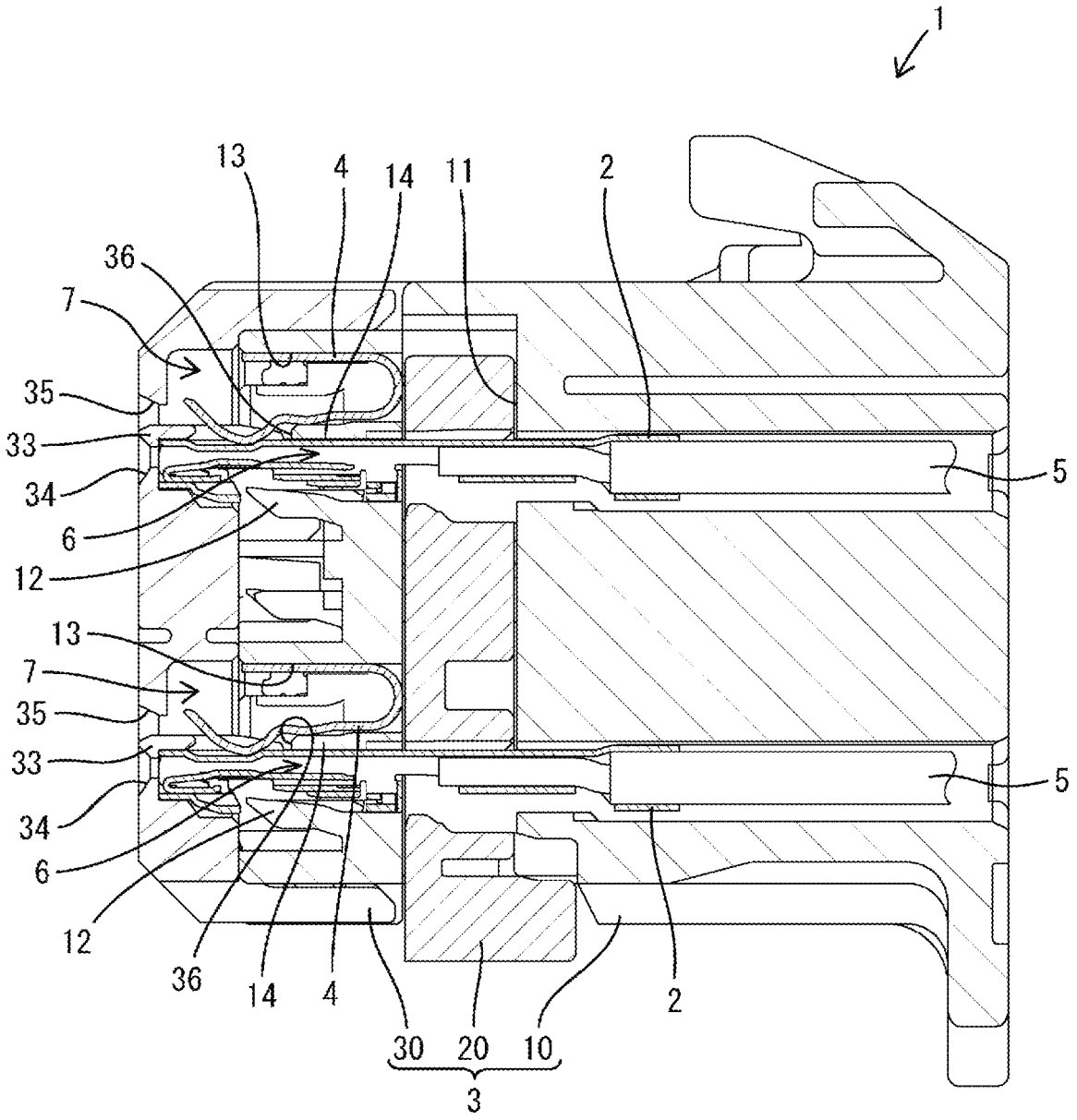
FIG. 1 is a side view in section showing a state where shorting terminals are assembled in a connector of one embodiment.
Figure 2:
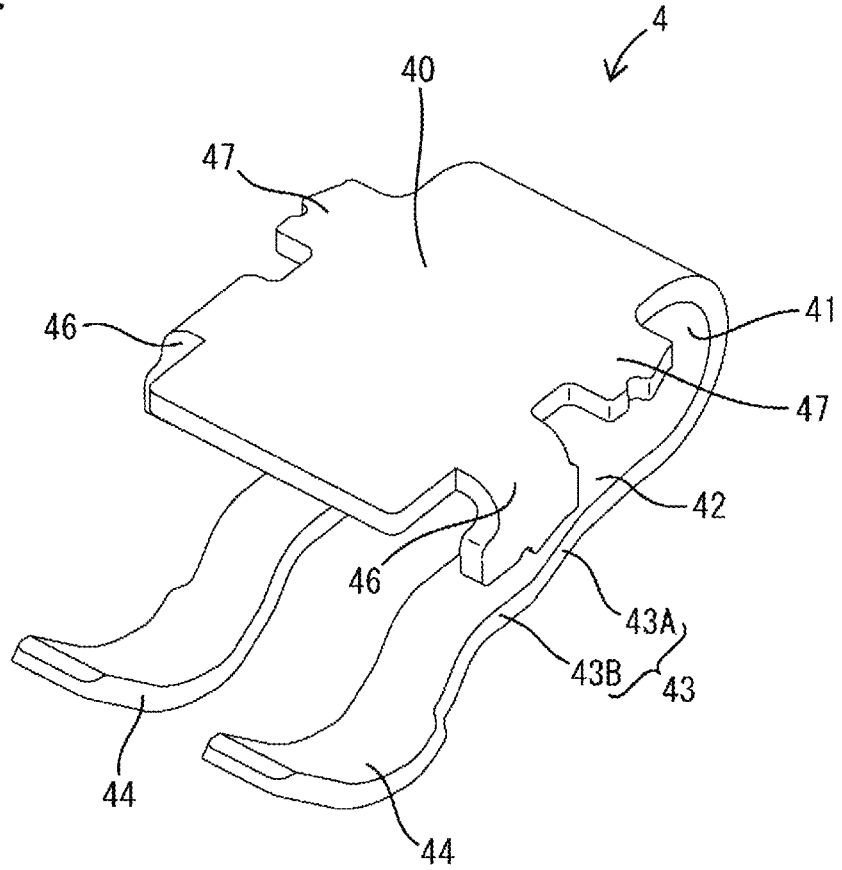
FIG. 2 is a perspective view of the shorting terminal viewed obliquely from front.
Figure 3:
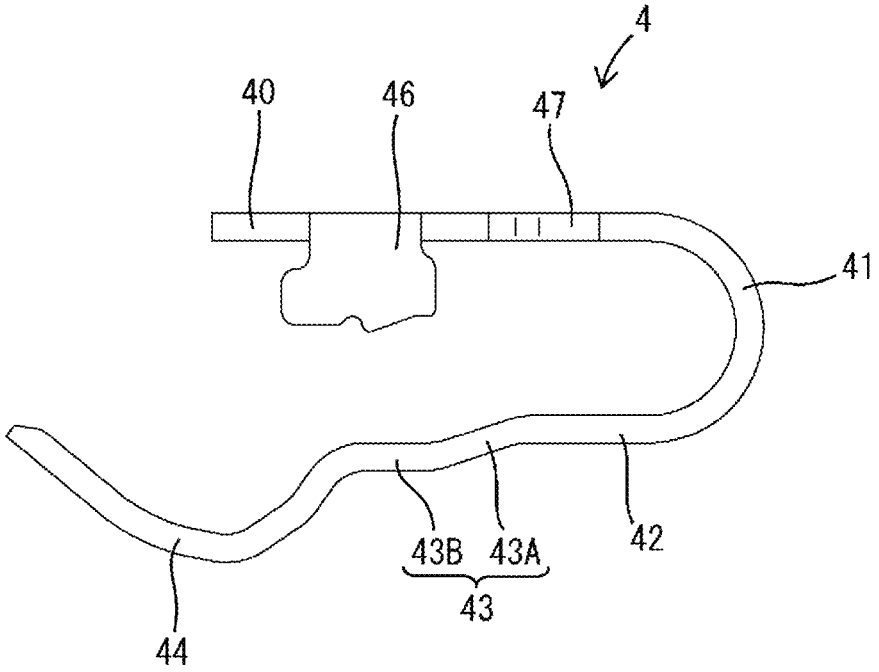
FIG. 3 is a side view of the shorting terminal.
Figure 4:
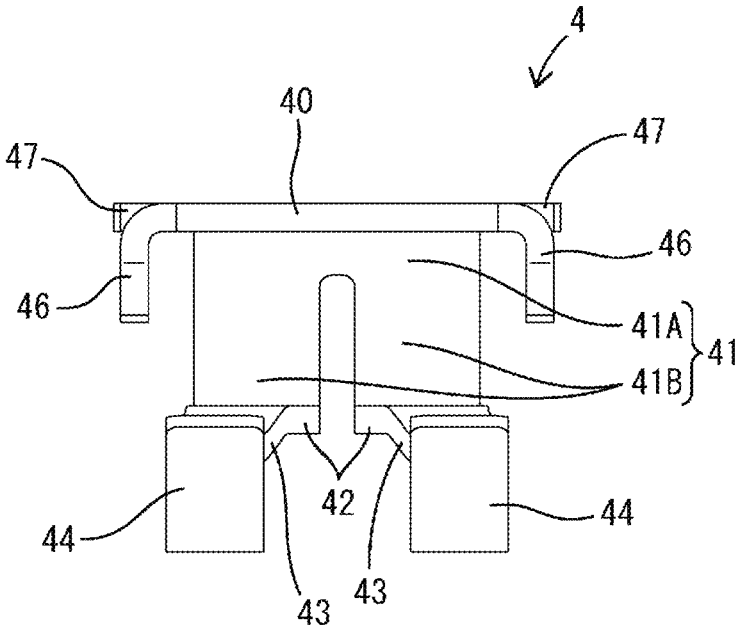
FIG. 4 is a front view of the shorting terminal.
Figure 5:
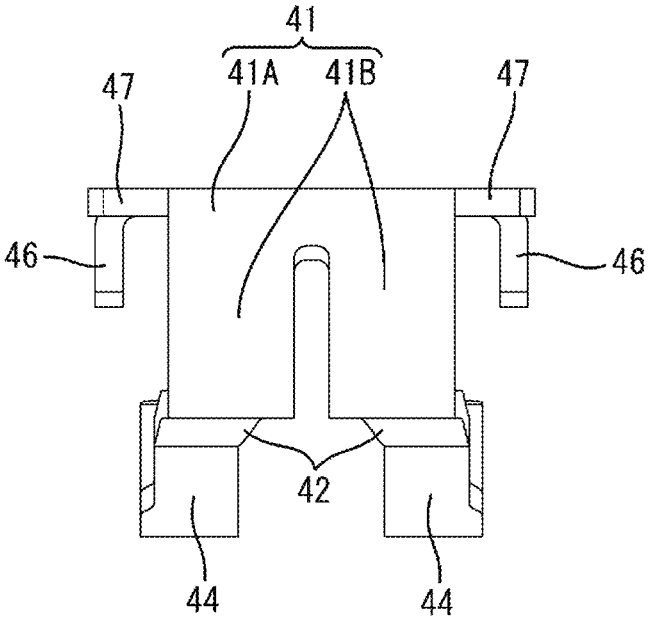
FIG. 5 is a back view of the shorting terminal.
Figure 6:
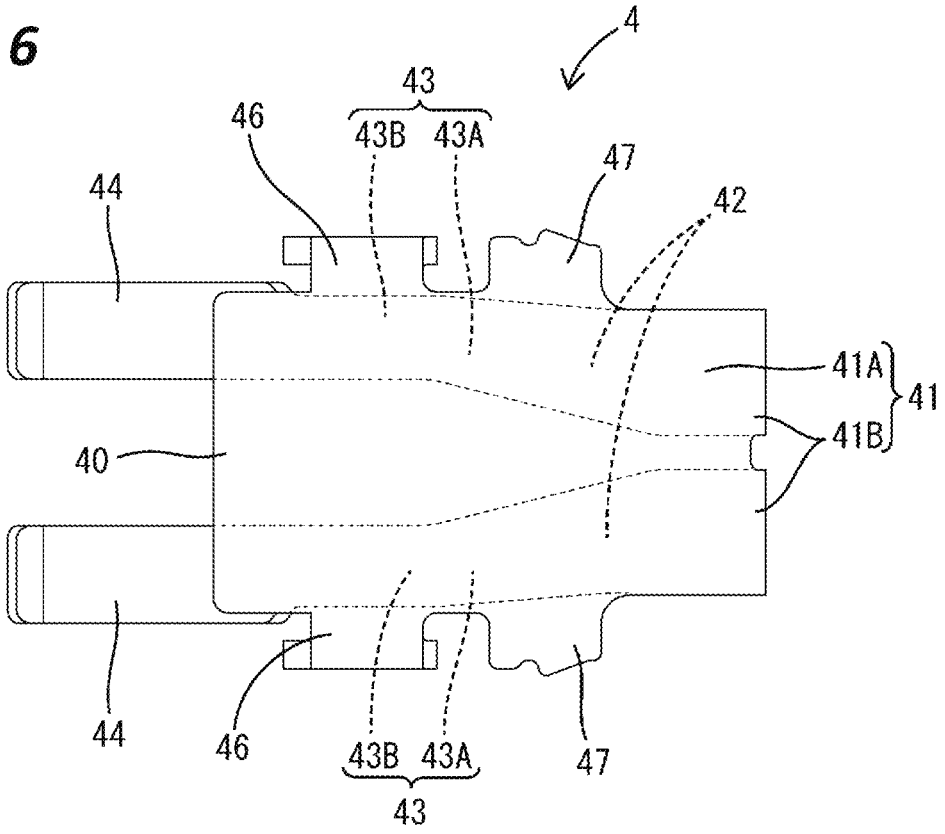
FIG. 6 is a plan view of the shorting terminal.

A connector 1 of this embodiment includes, as shown in FIG. 1, a plurality of terminal fittings 2, a housing 3 capable of accommodating the plurality of terminal fittings 2 and a plurality of shorting terminals 4 for shorting the terminal fittings 2 accommodated in the housing 3. The terminal fitting 2 is a female terminal fitting and formed into an elongated tubular shape as a whole, such as by bending a metal plate. An end part of a wire 5 is connected to a rear end part of the terminal fitting 2 by crimping.

The housing 3 is made of synthetic resin and in the form of a rectangular tube as a whole. The housing 3 includes a housing body 10, a retainer 20 and a front mask 30. The housing body 10 is formed with a retainer fitting groove 11 open downward. The retainer 20 is assembled into the housing body 10 by being fit into the retainer fitting groove 11. The front mask 30 is in the form of a flat plate having a thickness in the front-rear direction, and assembled with the housing body 10 to cover the front end of the housing body 10.

The housing 3 is formed with a plurality of terminal accommodation chambers 6 capable of individually accommodating the plurality of terminal fittings 2 and a plurality of shorting terminal accommodation chambers 7 capable of individually accommodating the plurality of shorting terminals 4.

Each terminal accommodation chamber 6 is elongated in the front-rear direction. The terminal fitting 2 is inserted into each terminal accommodation chamber 6 from behind, and the inserted terminal fitting 2 is preventing from coming out rearward by a locking lance 12 provided on a lower side of each terminal accommodation chamber 6. The terminal fitting 2 accommodated in the terminal accommodation chamber 6 has a forward movement restricted by the front mask 30. The front mask 30 is formed with a plurality of mating terminal insertion openings 34 individually corresponding to the plurality of terminal accommodation chambers 6. A mating terminal fitting (not shown) inserted in the terminal accommodation chamber 6 through the mating terminal insertion opening 34 contacts the terminal fitting 2 accommodated in the terminal accommodation chamber 6 to be shorted. The respective terminal accommodation chambers 6 are disposed in parallel in the lateral direction.

The respective shorting terminal accommodation chambers 7 are disposed along the terminal accommodation chambers 6 above (side opposite to the locking lances 12) the terminal accommodation chambers 6. One shorting terminal accommodation chamber 7 is provided for two laterally adjacent terminal accommodation chambers 6. Each shorting terminal accommodation chamber 7 has a flat shape long in the lateral direction in a front view. Both left and right and upper surfaces of each shorting terminal accommodation chamber 7 are respectively closed in entire regions. An opening on the rear end of each shorting terminal accommodation chamber 7 communicates with the retainer fitting groove 11. The opening on the rear end of each shorting terminal accommodation chamber 7 is closed by the retainer 20 fit into the retainer fitting groove 11. The front mask 30 is formed with a plurality of releasing rib insertion openings 35 open in a front surface. The respective releasing rib insertion openings 35 are individually provided to correspond to the respective shorting terminal accommodation chambers 7, and communicate with the respective shorting terminal accommodation chambers 7.

Front partition walls 33 are formed between the mating terminal insertion openings 34 and the releasing rib insertion openings 35. Rear partition walls 24 partitioning between the shorting terminal accommodation chambers 7 and the terminal accommodation chambers 6 are formed on the lower surfaces of rear end parts of the shorting terminal accommodation chambers 7. Communicating portions 36 allowing communication between the shorting terminal accommodation chambers 7 and the terminal accommodation chambers 6 are formed in front of the rear partition walls 14 (between the front partition walls 33 and the rear partition walls 14).

Each shorting terminal accommodation chamber 7 includes a shorting terminal holding chamber 13 constituting a rear end part of the shorting terminal accommodation chamber 7. Both left and right and upper surfaces of each shorting terminal holding chamber 13 are respectively closed in entire regions. An opening on the rear end of each shorting terminal holding chamber 13 is closed by the retainer 20 fit into the retainer fitting groove 11. The rear partition wall 14 constitutes a lower surface part of each shorting terminal holding chamber 13. Each shorting terminal holding chamber 13 is formed in a front end part of the housing body 10 and open in the front surface of the housing 3. The shorting terminal 4 is disposed in the shorting terminal accommodation chamber 7 by being fit into the shorting terminal holding chamber 13 from front.

Shorting Terminal 4

Figure 11B:
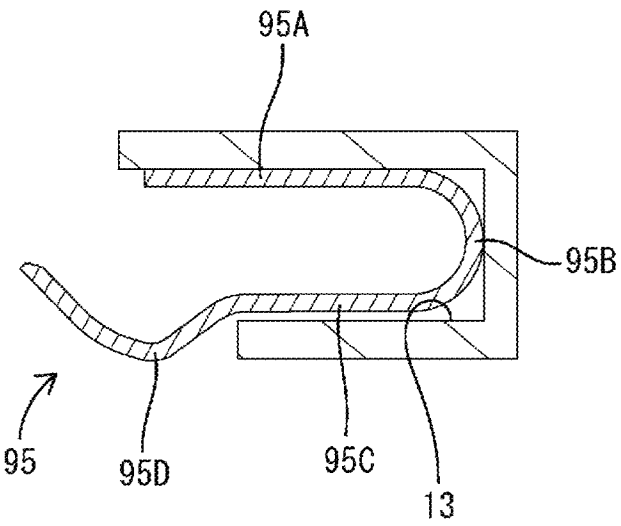
FIG. 11A is a schematic side view in section showing a state before a conventional first shorting terminal is assembled into the housing and FIG. 11B is a schematic side view in section showing a state where the conventional first shorting terminal is assembled in the housing body.
Figure 11A:
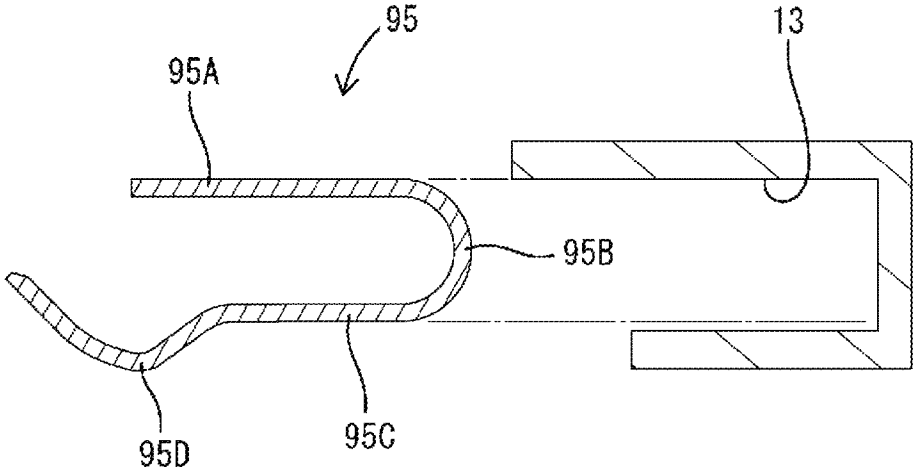

Conventionally, there has been a problem that a part of the shorting terminal 4 in contact with the terminal fitting 2 is not stable in the case of disposing the shorting terminal 4 in the shorting terminal holding chamber 13. For example, as shown in FIG. 11A and FIG. 11B, a conventional first shorting terminal 95 includes a base portion 95A, a folded portion 95B, an opposing portion 95C and a contact portion 95D. Since the housing 3 formed with the shorting terminal holding chambers 13 is made of synthetic resin, heights (inner dimensions) of the shorting terminal holding chambers 13 vary during molding. Accordingly, the first shorting terminal 95 is formed such that an interval between the outer surfaces of the base portion 95A and the opposing portion 95C is smaller than the height (inner dimension) of the shorting terminal holding chamber 13 (see FIG. 11(A)) so that the first shorting terminal 95 is accommodated in the shorting terminal holding chamber 13 regardless of a variation during molding. However, since the first shorting terminal 95 accommodated in the shorting terminal holding chamber 13 rattles in a height direction and the position of the contact portion 95D is not stabilized (see FIG. 11(B)) since a clearance in the height direction is formed between the first shorting terminal 95 and the shorting terminal holding chamber 13.

Figure 12B:
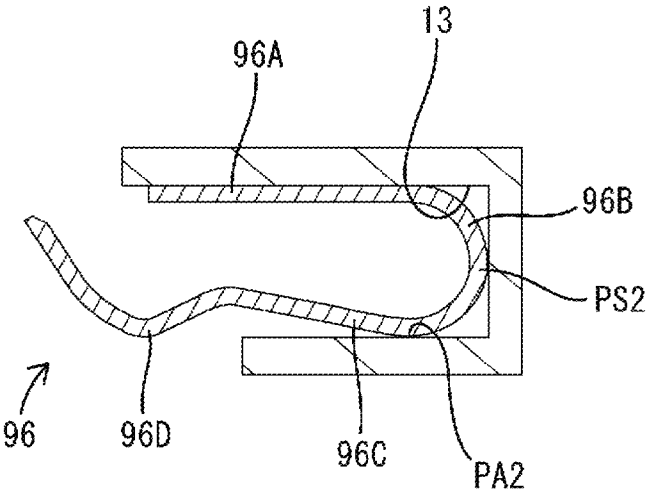
FIG. 12A is a schematic side view in section showing a state before a conventional second shorting terminal is assembled into the housing and FIG. 12B is a schematic side view in section showing a state where the conventional second shorting terminal is assembled in the housing body.
Figure 12A:
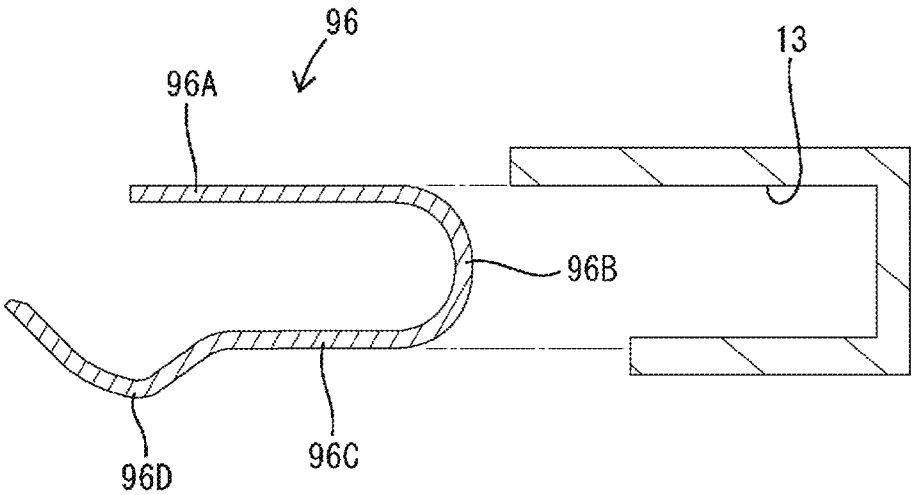

Further, a conventional second shorting terminal 96 shown in FIG. 12A and FIG. 12B includes a base portion 96A, a folded portion 96B, an opposing portion 96C and a contact portion 96D. Since this second shorting terminal 96 is formed such that an interval between the outer surfaces of the base portion 96A and the opposing portion 96C is larger than the height (inner dimension) of the shorting terminal holding chamber 13 (see FIG. 12A), the second shorting terminal 96 is held in a deflected state in the shorting terminal holding chamber 13 and rattling is suppressed. However, an amount of deflection of the second shorting terminal 96 also varies according to a variation during the molding of the shorting terminal holding chamber 13. At this time, the position of the contact portion 96D fluctuates with a vertically central part of the folded portion 96B serving as a fulcrum PS2 and a part of the folded portion 96B in contact with the shorting terminal holding chamber 13 serving as a point of action PA2. Thus, a problem that the position of the contact portion 96D also varies according to a variation of the amount of deflection of the second shorting terminal 96 has similarly occurred (see FIG. 12B). In contrast, the shorting terminal 4 of this embodiment solves the above problem as follows.

As shown in FIGS. 2 to 7, the shorting terminal 4 is formed to have a bilaterally symmetrical shape, such as by bending a metal plate long in one direction. The shorting terminal 4 is a single member in which a base portion 40, a folded portion 41, opposing portions 42, protruding portions 43 and contact portions 44 are successively connected in a side view. A lateral width of the shorting terminal 4 is smaller than that of the shorting terminal holding chamber 13.

The base portion 40 is in the form of a flat plate disposed in an upper end part of the shorting terminal 4 and extending along a horizontal direction. The base portion 40 has a substantially rectangular shape in a plan view. The folded portion 41 is connected to the rear end edge (end edge on a side of the contact portions 44 in a length direction in a side view and on the side opposite to the contact portions 44 in the front-rear direction) of the base portion 40.

The folded portion 41 extends rearward from the rear end edge of the base portion 40 and is bent downward while describing a semicircle in a side view. In a front view, a region on a tip side in an extending direction of the folded portion 41 is laterally branched into two parts. Specifically, the folded portion 41 includes an unbranched portion 41A on an upper end side and a pair of branched portions 41B on a lower end side extending from the unbranched portion 41A while being laterally spaced apart. A boundary between the unbranched portion 41B and the branched portions 41B is disposed above a vertical center of the folded portion 41. A width of a clearance formed between the pair of branched portions 41B is constant and smaller than a lateral width of each branched portion 41B.

A pair of the opposing portions 42 are connected to the extending end edge (end edges on a side of the contact portions 44 in the length direction in a side view) of the folded portions 41 (the pair of branched portions 41B). Each opposing portion 42 is in the form of a flat plate. The pair of opposing portions 42 extend forward substantially horizontally from the lower end edges of the pair of branched portions 41B. The pair of opposing portions 42 are substantially parallel to each other. A lateral width of each opposing portion 42 becomes gradually smaller toward the front (toward the contact portion 44). The pair of opposing portions 42 are formed such that a width of a clearance formed between the pair of opposing portions 42 becomes gradually wider toward the front (toward the contact portions 44). The pair of opposing portions 42 are formed such that an interval between the laterally outer end edges of the respective opposing portions 42 is kept substantially contact (more particularly, becomes slightly wider toward the contact portions 44).

The pair of opposing portions 42 are formed such that a vertical interval between the lower surfaces of the both opposing portions 42 (outer surface of the shorting terminal 4) and the upper surface of the base portion 40 (outer surface of the shorting terminal 4) are smaller than an inner dimension (height) between the upper surface and the lower surface (upper stage surface 55 to be described later) of the shorting terminal holding chamber 13. A length in the front-rear direction of each opposing portion 42 is smaller than that of the base portion 40. The positions of the rear end edges of the pair of opposing portions 42 are aligned with the rear end edge of the base portion 40 in the front-rear direction. The front end edges of the pair of opposing portions 42 are disposed behind the position of the front end edge of the base portion 40.

A pair of the protruding portions 43 are connected to end edges (front end edges) of the pair of opposing portions 42 on the side of the contact portions 44. Each protruding portion 43 is shaped to include a step-like bent part in a side view. The pair of protruding portions 43 extend forward from the front end edges of the pair of opposing portions 42. Each protruding portion 43 includes an inclined portion 43A connected to the opposing portion 42 and an acting portion 43B linking the inclined portion 43A and the contact portion 44.

Figure 7:
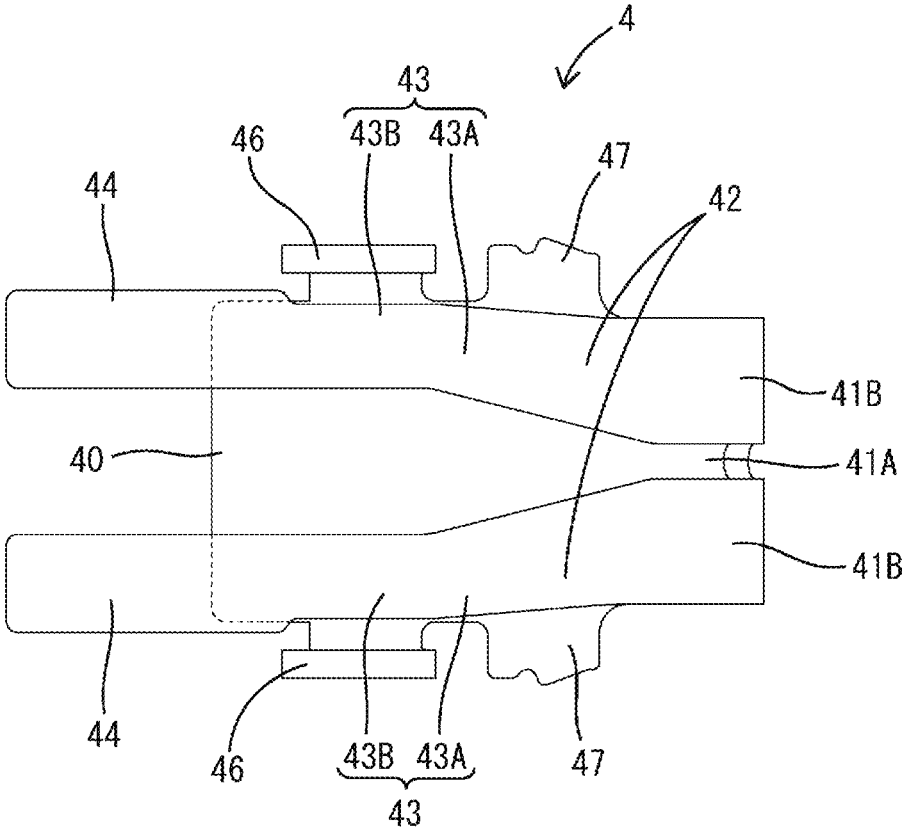
FIG. 7 is a bottom view of the shorting terminal.

A pair of the inclined portions 43A are inclined obliquely downward toward the front away from the base portion 40 (to project toward the terminal accommodation chambers 6 toward the contact portions 44) in a side view. Specifically, the inclined portions 43A and the opposing portions 42 are connected at an obtuse angle. A lateral width of each inclined portion 43A becomes smaller toward the contact portion 44. As shown in FIG. 7, the pair of inclined portions 43A are formed such that a width of a clearance formed between the pair of inclined portions 43A becomes wider toward the contact portions 44. The pair of inclined portions 43A are formed such that an interval between the laterally outer end edges of the pair of inclined portions 43A is kept substantially constant (more particularly, becomes slightly wider toward the contact portions 44). A length in the front-rear direction of each inclined portion 43A is smaller than that of the base portion 40 and smaller than that of the opposing portion 42. The positions in the front-rear direction of the pair of inclined portions 43A substantially coincide with a central part in the front-rear direction of the base portion 40.

A pair of the acting portions 43B are connected to end edges (front end edges) of the pair of inclined portions 43A on the side of the contact portions 44. The pair of acting portions 43B extend forward from the front end edges of the pair of inclined portions 43A. The pair of acting portions 43B are disposed below (side of the terminal accommodation chambers 6) the opposing portions 42 and extend substantially in parallel to the base portion 40. Specifically, the pair of acting portions 43B (pair of protruding portions 43) protrude downward with respect to the opposing portions 42. In this way, a vertical dimension between the lower surfaces (outer surface of the shorting terminal 4) of the pair of acting portions 43B (protruding portions 43) and the upper surface (outer surface of the shorting terminal 4) of the base portion 40 is larger than an inner dimension (height) between the upper surface and the lower surface (lower stage surface 57 to be described later) of the shorting terminal holding chamber 13.

A lateral width of each acting portion 43B is constant. A width of a clearance formed between the pair of acting portions 43B is constant and larger than the lateral width of each acting portion 43B. The laterally inner and outer end edges of the pair of acting portions 43B extend in parallel in the front-rear direction. The positions of the laterally outer end edges of the pair of acting portions 43B are substantially aligned with both left and right end edges of the base portion 40 in the lateral direction. The front end edges of the pair of acting portions 43B are located behind the front end edge of the base portion 40.

A pair of the contact portions 44 are connected to the front end edges of the pair of acting portions 43B. The pair of contact portions 44 extend forward from the front end edges of the pair of acting portions 43B (protruding portions 43). Each contact portion 44 has a substantially rectangular shape long in the front-rear direction in a plan view and has a curved shape protruding downward (toward the terminal accommodation chamber 6) in a side view. A lateral width of each contact portion 44 is substantially constant. A width of a clearance formed between the pair of contact portions 44 is constant and larger than the lateral width of each contact portion 44. The laterally inner and outer end edges of the pair of contact portions 44 extend in parallel in the front-rear direction. The laterally inner end edges of the respective contact portions 44 are formed to be flush with the laterally inner end edges of the respective acting portions 43B. The laterally outer end edges of the respective contact portions 44 protrude further outward than the laterally outer end edges of the respective acting portions 43B (protruding portions 43) and protrude further laterally outward than the both left and right end edges of the base portion 40.

A tip (lowest point) of a downward bulging part of each contact portion 44 serves as a contact point portion 44P configured to contact the upper surface of the terminal fitting 2. The contact point portion 44P is formed to be substantially aligned with the front end edge of the base portion 40 in the front-rear direction. Specifically, the rear end edge of each contact portion 44 is located behind the front end edge of the base portion 40, and the front end edge of each contact portion 44 is located in front of the front end edge of the base portion 40. The front end edge of each contact portion 44 is located below the upper surface of the opposing portion 42 and above the upper surface of the acting portion 43B.

A pair of left and right first fitting portions 46 and a pair of left and right second fitting portions 47 disposed behind the first fitting portions 46 are formed on the both left and right end edges of the base portion 40. The pair of first fitting portions 46 project laterally outward from the both left and right end edges of the base portion 40 and are bent downward. The lower end edge of each first fitting portion 46 extends in the front-rear direction. The lower end edge of each first fitting portion 46 extends up to a vertically central part of the folded portion 41 in the vertical direction. The first and second fitting portions 46, 47 project further laterally outward than the laterally outer end edges of the pair of contact portions 44. The pair of second fitting portions 47 project laterally outward from the both left and right end edges of the base portion 40. The respective second fitting portions 47 project further laterally outward than the respective first fitting portions 46.

Mounting of Shorting Terminals 4

Figure 8:
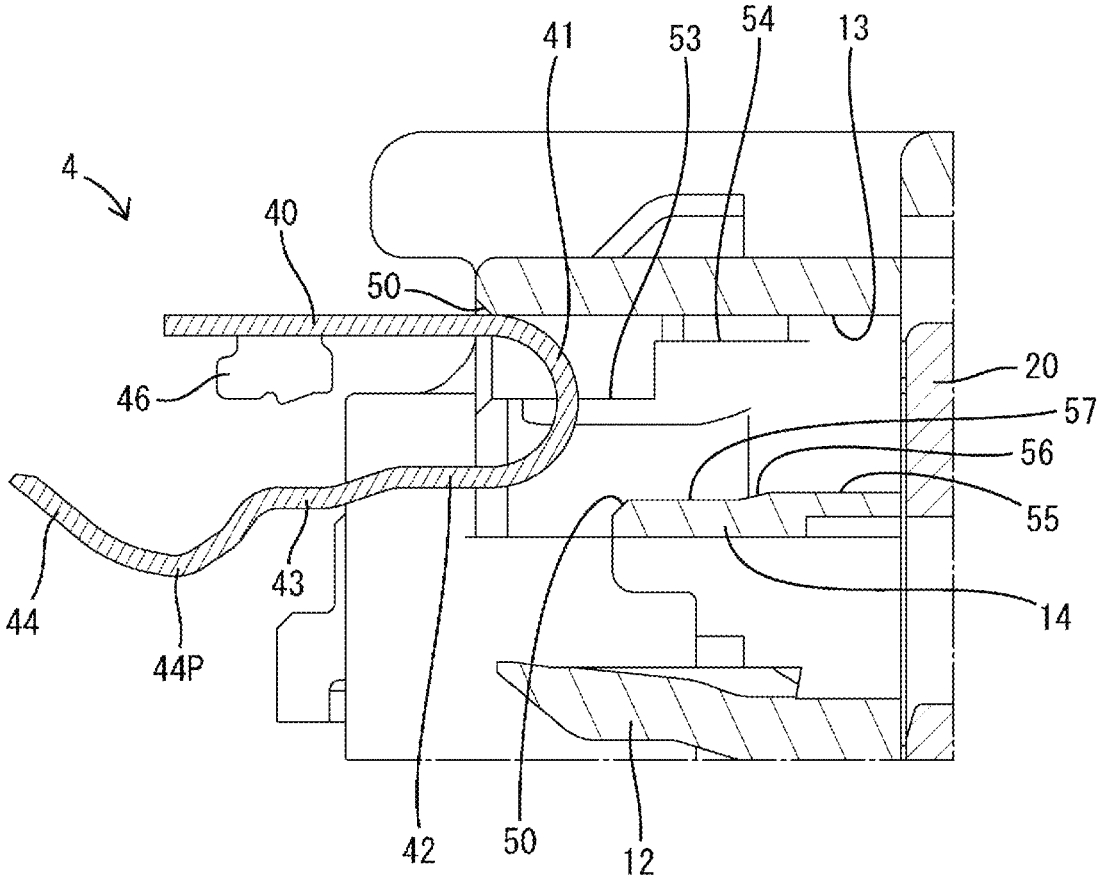
FIG. 8 is a partial enlarged side view in section showing a state before the shorting terminal is assembled into a housing body.

As shown in FIG. 8, the shorting terminal 4 is fit into the shorting terminal holding chamber 13 from front in such a posture that the contact portions 44 project forward and the contact point portions 44P project downward (toward the terminal accommodation chambers 6). Guide surfaces 50 inclined downward toward an opening side are formed on both upper and lower front opening end edges of the shorting terminal holding chamber 13. The shorting terminal 4 is fit into the shorting terminal holding chamber 13 by being guided by the guide surfaces 50. The first fitting portions 46 are fit into first fitting grooves 53 in both left and right inner surfaces of the shorting terminal holding chamber 13 and the second fitting portions 47 are fit into second fitting grooves 54 in the both left and right inner surfaces of the shorting terminal holding chamber 13, whereby the shorting terminal 4 is fixed in the shorting terminal holding chamber 13.

The lower surface of the shorting terminal holding chamber 13 (upper surface of the rear partition wall 14) is formed with the upper stage surface 55, an inclined surface 56 and the lower stage surface 57. The upper stage surface 55 is formed on a rear end part of the lower surface of the shorting terminal holding chamber 13 and extends substantially horizontally. The lower stage surface 57 is formed on a front end part of the lower surface of the shorting terminal holding chamber 13 and extends substantially horizontally. The lower stage surface 57 is disposed below the upper stage surface 55. The rear end edge of the inclined surface 56 is connected to the front end edge of the upper stage surface 55 and the front end edge thereof is connected to the rear end edge of the lower stage surface 57. Further, the inclined surface 56 is inclined downward toward the front.

Figure 9:
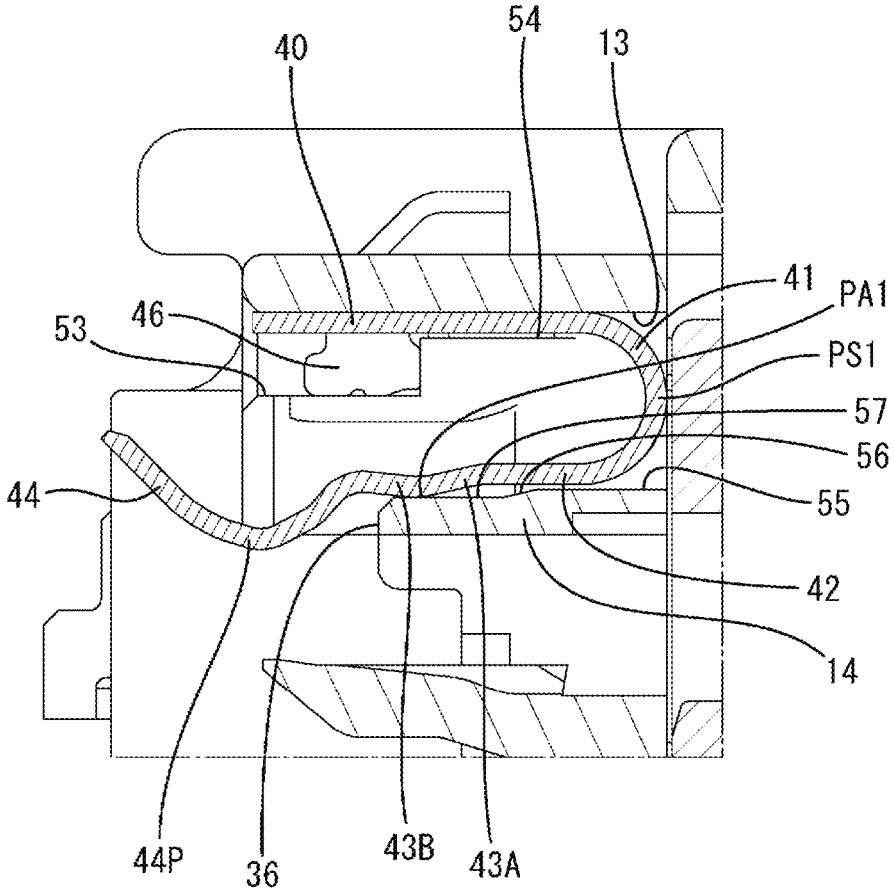
FIG. 9 is a partial enlarged side view in section showing a state where the shorting terminal is assembled in the housing body.

As shown in FIG. 9, the following state is attained if the shorting terminal 4 is fit into the shorting terminal holding chamber 13. The upper surface of the base portion 40 is in surface contact with the upper surface (ceiling surface) of the shorting terminal holding chamber 13. The lower surfaces of the rear end parts of the acting portions 43B are in surface contact with the lower surface (lower stage surface 57) of the shorting terminal holding chamber 13. Here, a state where the lower surfaces of the rear end parts of the acting portions 43B are in surface contact with the lower surface (lower stage surface 57) of the shorting terminal holding chamber 13 is a state where the shorting terminal 4 fit into the shorting terminal holding chamber 13 is stable to such an extent as not to be shifted in position when the terminal fittings 2 are inserted or a mating connector (not shown) is connected. The folded portion 41 is resiliently deformed to reduce a radius of curvature. By a resilient restoring force of this folded portion 41, the upper surface of the base portion 40 receives an inward (downward) resilient reaction force from the ceiling surface of the shorting terminal holding chamber 13 and the protruding portions 43 (acting portions 43B) receive an inward (upward) resilient reaction force from the lower surface (lower stage surface 57) of the shorting terminal holding chamber 13.

With the shorting terminal 4 fit in the shorting terminal holding chamber 13, the protruding portions 43 (acting portions 43B) are in contact with the opening end edge of the shorting terminal holding chamber 13 (front end part of the shorting terminal holding chamber 13). The lower end part of the folded portion 41, the opposing portions 42 and the inclined portions 43A are not in contact with the lower surface (any of the upper stage surface 55, the inclined surface 56 and the lower stage surface 57) of the shorting terminal holding chamber 13 and are lifted from the lower surface of the shorting terminal holding chamber 13. The front end parts of the acting portions 43B and the contact portions 44 entirely project forward outside the shorting terminal holding chamber 13 from the front end of the rear partition wall 14.

With the shorting terminal 4 fit in the shorting terminal holding chamber 13 in this way, the folded portion 41 serves as a fulcrum PS1 and the protruding portions 43 (acting portions 43B) serve as a point of action PA1 with respect to the contact portions 44. In contrast, in the second shorting terminal 96 (see FIG. 12A and FIG. 12B), the folded portion 96B serves as the fulcrum PA1 and the point of action PA2 with respect to the contact portion 96D. Specifically, the point of action PA1 of the shorting terminal 4 is located closer to the contact portions 44 than the point of action PA2 of the second shorting terminal 96 (see FIG. 12A and FIG. 12B) between the fulcrum PS1 and the contact portions 44. Since the position (displacement amount) of the point of action PA1 changes according to a variation of the inner dimension of the shorting terminal holding chamber 13, the positions of the contact portions 44 also change according to the variation of the inner dimension of the shorting terminal holding chamber 13. However, as compared to the second shorting terminal 96 (see FIG. 12A and FIG. 12B) in which the position of the contact portion 96D fluctuates with the folded portion 96B serving as the point of action PA1, a variation of the positions of the contact portions 44 associated with the variation of the inner dimension of the shorting terminal holding chamber 13 is suppressed to be small in the shorting terminal 4 of this embodiment since a distance between the point of action PA1 (protruding portions 43) and the contact portions 44 is short.

Figure 10:
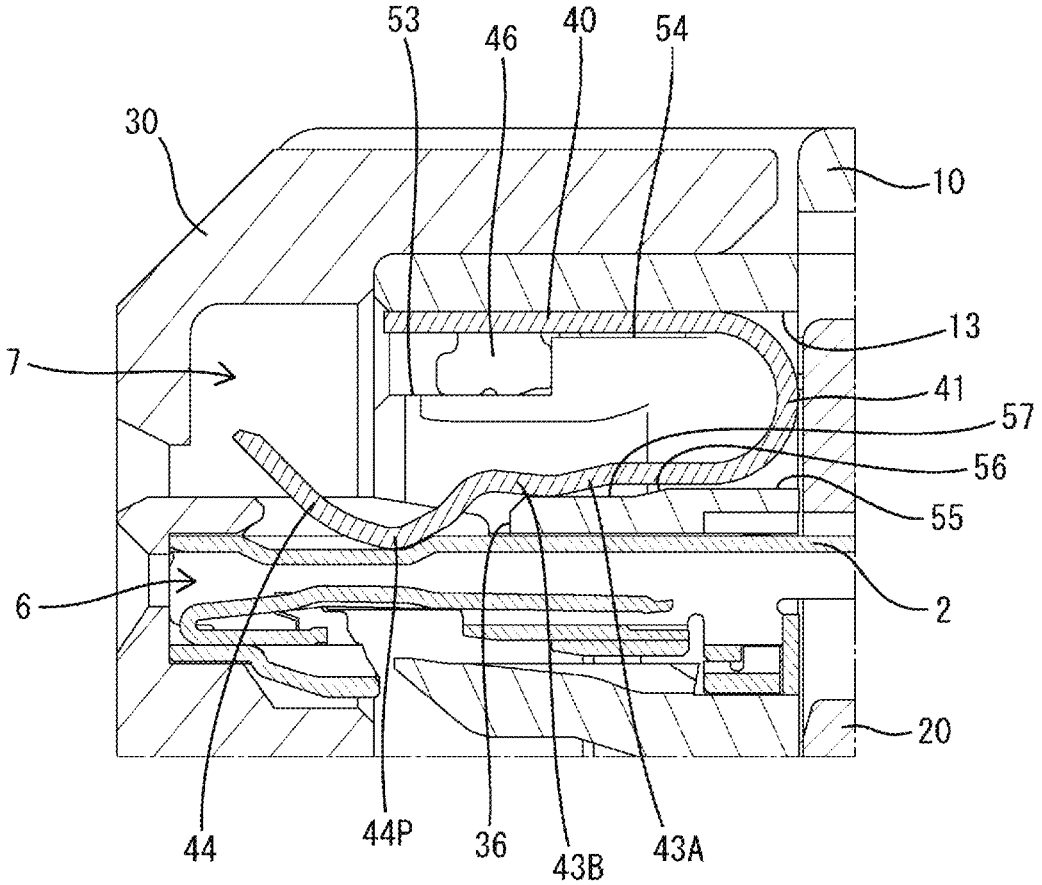
FIG. 10 is a partial enlarged side view in section showing a state where the shorting terminal and terminal fittings are assembled in a housing.

After the shorting terminal 4 is mounted into the shorting terminal holding chamber 13 (shorting terminal accommodation chamber 7), the front mask 30 is assembled with the front end of the housing 10 as shown in FIG. 10. In this state, the pair of contact portions 44 (contact point portions 44P) respectively enter the corresponding terminal accommodation chambers 6 through the communicating portions 36. When the terminal fittings 2 are inserted into the respective terminal accommodation chambers 6, the respective contact portions 44 are pushed toward the shorting terminal accommodation chambers 7 by the terminal fittings 2, move upward while being kept in contact with the terminal fittings 2 and a state where the respective contact portions 44 are in contact with the outer peripheral surfaces of the terminal fittings 2 is maintained. If a state where the respective contact portions 44 of one shorting terminal 4 are respectively in contact with the terminal fittings 2 is reached, these two terminal fittings 2 are shorted via the shorting terminal 4.

Functions and Effects of Embodiment

As described above, the shorting terminal 4 of this embodiment includes the base portion 40, the contact portions 44, the folded portion 41, the opposing portions 42 and the protruding portions 43. The base portion 40 is in the form of a flat plate. The contact portions 44 can contact a pair of the terminal fittings 2 to short the pair of terminal fittings 2. The folded portion 41 extends in such a manner as to be folded from the base portion 40. The opposing portions 42 extend from the folded portion 41 toward the contact portions 44 substantially in parallel to the base portion 40, and are formed such that an interval between the outer surfaces of the base portion 40 and the opposing portions 42 is smaller than an interval between opposing inner surfaces of the shorting terminal holding chamber 13. The protruding portions 43 extend from the opposing portions 42 to the contact portions 44 and are formed such that an interval between the outer surfaces of the base portion 40 and the protruding portions 43 is larger than the interval between the opposing inner surfaces of the shorting terminal holding chamber 13.

This shorting terminal 4 is accommodated in a deflected state into the shorting terminal holding chamber 13 after the base portion 40 and the protruding portions 43 are fit into the shorting terminal holding chamber 13. If the inner dimension of the shorting terminal holding chamber 13, i.e. an opposing interval between the base portion 40 and the protruding portions 43 varies, the amount of deflection of the folded portion 41 also varies. Thus, the positions of the contact portions 44 fluctuate with the folded portion 41 serving as the fulcrum PS1. At this time, the protruding portions 43 serve as the point of action PA1 for fluctuating the positions of the contact portions 44 and a variation amount of the displacing point of action PA1 (protruding portions 43) has a fixed relationship with a variation amount of the inner dimension of the shorting terminal holding chamber 13. The protruding portions 43 are disposed at positions closer to the contact portions 44 than the folded portion 41. Thus, the distance between the point of action PA1 (protruding portions 43) and the contact portions 44 is short in the shorting terminal 4 as compared to the second shorting terminal 96 in which the position of the contact portion 96D fluctuates with the folded portion 96B serving as the point of action PA2. Therefore, a variation of the positions of the contact portions 44 associated with a variation of the inner dimension of the shorting terminal holding chamber 13 is suppressed to be small.

Further, the protruding portions 43 are accommodated into the shorting terminal holding chamber 13 while being in contact with the end edge on the opening side of the shorting terminal holding chamber 13. In this way, the point of action PA1 (protruding portions 43) is disposed at a position closest to the contact portions 44 in the shorting terminal holding chamber 13, wherefore a variation of the positions of the contact portions 44 associated with a variation of the inner dimension of the shorting terminal holding chamber 13 can be effectively suppressed.

Further, in a state fit in the shorting terminal holding chamber 13, the protruding portions 43 are in surface contact with the inner wall surface of the shorting terminal holding chamber 13. By bringing the protruding portions 43 into surface contact with the inner wall surface of the shorting terminal holding chamber 13, the disposed position of the shorting terminal 4 in the shorting terminal holding chamber 13 can be stabilized. As a result, it can be suppressed that the shorting terminal 4 fit into the shorting terminal holding chamber 13 is shifted in position when the terminal fittings 2 are inserted or when the mating connector (not shown) is connected.

Further, the connector 1 of this embodiment includes the housing 3 formed with the shorting terminal holding chambers 13 and the shorting terminals 4 to be accommodated into the shorting terminal holding chambers 13. Therefore, in the connector 1, the disposed positions of the contact portions 44 of the shorting terminals 4 accommodated in the shorting terminal holding chambers 13 can be stabilized.

Further, the guide surface 50 inclined downward toward the opening side is formed on the end edge on the opening side of the inner wall surface (lower surface) of the shorting terminal holding chamber 13. Therefore, the protruding portions 43 of the shorting terminal 4 can be guided into the shorting terminal holding chamber 13 by the guide surface 50.

Other Embodiments

The present invention is not limited to the above described and illustrated embodiment. For example, the following embodiments are also included in the technical scope of the present invention.

(1) In the above embodiment, the acting portions are in surface contact with the inner wall surface of the shorting terminal holding chamber with the shorting terminal fit in the shorting terminal holding chamber. However, the acting portions may not be in surface contact with the inner wall surface of the shorting terminal holding chamber. For example, acting portions may be bent at an acute angle toward the inner wall surface in a side view and may be in point contact (line contact) with the inner wall surface.

(2) Although the shorting terminal accommodation chambers (shorting terminal holding chambers) are arranged above the terminal accommodation chambers in the above embodiment, shorting terminal accommodation chambers may be arranged below terminal accommodation chambers.

LIST OF REFERENCE NUMERALS

1 . . . connector
2 . . . terminal fitting
3 . . . housing
4 . . . shorting terminal
6 . . . terminal accommodation chamber
7 . . . shorting terminal accommodation chamber
10 . . . housing body
13 . . . shorting terminal holding chamber
14 . . . rear partition wall
20 . . . retainer
30 . . . front mask
40 . . . base portion
41 . . . folded portion
42 . . . opposing portion
43 . . . protruding portion
43A . . . inclined portion
43B . . . acting portion
44 . . . contact portion

What is claimed is:

1. A connector, comprising:
a plurality of terminal fittings,
a housing for accommodating the terminal fittings; and
a shorting terminal to be accommodated into a shorting terminal holding chamber formed in the housing,
wherein:
the shorting terminal includes:
a base portion in the form of a flat plate;
a contact portion capable of shorting a pair of terminal fittings by contacting the pair of terminal fittings;
a folded portion extending in such a manner as to be folded from the base portion;
an opposing portion extending from the folded portion toward the contact portion, the opposing portion being formed such that an interval between the base portion and the opposing portion is smaller than an interval between opposing inner surfaces of a shorting terminal holding chamber; and
a protruding portion extending from the opposing portion to the contact portion and to be fit into the shorting terminal holding chamber, and
the protruding portion being formed such that an interval between the base portion and the protruding portion is larger than the interval between the opposing inner surfaces of the shorting terminal holding chamber.

2. The connector of claim 1, wherein the protruding portion is accommodated into the shorting terminal holding chamber while being in contact with an end edge on an opening side of the shorting terminal holding chamber.

3. The connector of claim 1, wherein the protruding portion is in surface contact with an inner wall surface of the shorting terminal holding chamber in a state fit in the shorting terminal holding chamber.

4. The connector of claim 1, wherein a guide surface inclined downward toward an opening side is formed on an end edge on the opening side of an inner wall surface of the shorting terminal holding chamber.

5. A shorting terminal, comprising:
a base portion in the form of a flat plate;
a contact portion capable of contacting and shorting;
a folded portion extending in such a manner as to be folded from the base portion;

an opposing portion extending from the folded portion toward the contact portion; and a protruding portion extending from the opposing portion to the contact portion, wherein:

the opposing portion is parallel to the base portion, the protruding portion includes an inclined portion connected to the opposing portion and an acting portion linking the inclined portion and the contact portion, the inclined portion is inclined away from the base portion toward the contact portion, and the acting portion is parallel to the base portion.

* * * * *